United States Patent [19]

Zaugg et al.

[11] Patent Number: 4,500,018

[45] Date of Patent: Feb. 19, 1985

[54] ROTARY SLIDING CLOSURE UNIT AND LIQUID MELT CONTAINER EMPLOYING THE SAME

[75] Inventors: Robert Zaugg, Baar; Werner Keller, Steinhausen, both of Switzerland

[73] Assignee: Stopinc Aktiengesellschaft, Baar, Switzerland

[21] Appl. No.: 395,304

[22] Filed: Jul. 6, 1982

[30] Foreign Application Priority Data

Jul. 15, 1981 [CH] Switzerland ..... 4631/81

[51] Int. Cl.[3] ..... B22D 41/08

[52] U.S. Cl. ..... 222/598; 222/512; 222/548

[58] Field of Search ..... 222/512, 548, 555, 598, 222/600; 164/437

[56] References Cited

U.S. PATENT DOCUMENTS

| | | | |
|---|---|---|---|
| 3,377,006 | 4/1968 | Bahm | 222/598 |
| 3,430,644 | 3/1969 | Lyman | 222/598 |
| 3,459,346 | 8/1969 | Tinnes | 164/337 X |
| 3,912,134 | 10/1975 | Poran | 222/555 X |

FOREIGN PATENT DOCUMENTS

| | | |
|---|---|---|
| 1417824 | 12/1975 | United Kingdom . |
| 2049132 | 4/1980 | United Kingdom . |
| 2033564 | 10/1980 | United Kingdom . |
| 2052703 | 5/1981 | United Kingdom . |

*Primary Examiner*—Stanley H. Tollberg
*Assistant Examiner*—Frederick R. Handren
*Attorney, Agent, or Firm*—Wenderoth, Lind & Ponack

[57] ABSTRACT

A rotary sliding closure unit includes a stationary support frame adapted to be mounted removably adjacent to pouring opening of a liquid melt container. A stationary refractory plate has therethrough a flow passage and has an annular, ring-shaped configuration. The stationary refractory plate is supported by the stationary support frame such that the flow passage is in communication with the pouring opening. A rotary refractory plate is positioned in sliding abutting contact with the stationary refractory plate, has therethrough a plurality of flow passages to be moved selectively into and out of alignment with the flow passage of the stationary refractory plate, and has an annular, ring-shaped configuration. A rotary support frame supports the rotary refractory plate against the stationary refractory plate for rotational movement with respect thereto. The stationary and rotary refractory plates have complementary, annular, abutting relative sliding surfaces. The stationary and rotary support frames are disc-shaped members. Structure is provided to coaxially align the stationary and rotary support frames, and the stationary and rotary refractory plates and to urge the rotary refractory plate toward the stationary refractory plate.

10 Claims, 2 Drawing Figures

ROTARY SLIDING CLOSURE UNIT AND LIQUID MELT CONTAINER EMPLOYING THE SAME

BACKGROUND OF THE INVENTION

The present invention relates to an improved rotary sliding closure unit and to a liquid melt container, such as a melting crucible, including such rotary sliding closure unit.

U.S. Pat. No. 3,430,644 discloses a rotary sliding closure unit designed such that a rotatable, fireproof, refractory, ring-shaped plate has a sliding surface which sets flush against two separate, stationary refractory plates, one of which contains a flow-through opening or passage which aligns with a drainspout of a liquid melt container, and the other of which is located diametrically opposite the first. With this arrangement, the greatest part of the sliding surface of the rotary ring-shaped plate is constantly exposed. This inherently results in that this ring-shaped plate is insufficiently supported against the effects of exterior forces, particularly the drive system for achieving rotation of such plate. Additionally, it is difficult to align precisely the two stationary refractory plates in the base area of the sliding closure unit on a joint bearing surface for the ring-shaped rotary plate. Even further, the plates can be installed and removed only if the base plate, which is mounted directly to the outside of the liquid melt container, also is removed.

SUMMARY OF THE INVENTION

With the above discussion in mind, it is the object of the present invention to provide a novel and improved rotary sliding closure unit and a liquid melt container employing the same which overcome the disadvantages of the prior art.

It is a more specific object of the present invention to provide such a rotary sliding closure unit and liquid melt container employing the same which guarantee trouble-free operation, particularly achieving a complete seal and enabling easy handling during practical operation.

The above objects are achieved in accordance with one aspect of the present invention by the provision of a rotary sliding closure unit including a stationary support frame adapted to be mounted removably adjacent the pouring opening of a liquid melt container. A stationary refractory plate has therethrough a flow passage and has an annular, ring-shaped configuration. The stationary refractory plate is supported by the stationary support frame such that the flow passage is in communication with the pouring opening. A rotary refractory plate is positioned in sliding abutting contact with the stationary refractory plate and has therethrough a plurality of flow passages to be moved selectively into and out of alignment with the flow passage of the stationary refractory plate. The rotary refractory plate has an annular, ring-shaped configuration. A rotary support frame supports the rotary refractory plate against the stationary refractory plate for rotational movement with respect thereto. The stationary and rotary refractory plates have complementary, annular, abutting relative sliding surfaces. The stationary and rotary support frames comprise respective disc-shaped members. Means is fixed to one of the support frames and coaxially aligns the stationary and rotary support frames and the stationary and rotary refractory plates and urges the rotary refractory plate toward the stationary refractory plate.

In accordance with a further aspect of the present invention, there is provided a liquid melt container including an outer jacket, an inner refractory lining, a pouring opening extending through the lining, and a rotary sliding closure unit for selectively blocking and unblocking the pouring opening, the rotary sliding closure unit being as above defined.

By these structural arrangements, all along the complementary sliding surfaces of the two refractory plates, there is achieved a safe, constant fit and support for the rotary refractory plate. In addition, any lubricants which may be placed on the sliding surfaces, for example, by impregnating the refractory plates with tar, are distributed more evenly and remain effective for a longer length of time. The formation of the two support frames as disc-shaped members makes it possible to very quickly replace either of the support frames or either of the refractory plates supported thereby. That is, the two support frames and the two refractory plates may be removed and replaced as a unit, making it possible to check the various elements of the unit from the exterior.

In accordance with further features of the present invention, the aligning and urging means extends through center openings in the annular, ring-shaped refractory plates. The disc-shaped support frames have hub portions extending into respective of the center openings. The aligning and urging means includes a bolt fixed in the hub of the stationary support frame and extending through the hub of the rotary support frame. A guide sleeve surrounds the bolt within a bore hole in the hub of the rotary support frame, and a spring acts between the guide sleeve and the rotary support frame to move the rotary support frame away from the guide sleeve. A spring rest is fixed axially adjustably to the hub of the rotary support frame, and the spring bears on the spring rest. The guide sleeve extends outwardly of the rotary support frame and a nut is threaded onto the outer end of the bolt and bears against the outer end of the guide sleeve at a position spaced from the outer extremity of the rotary support frame to define between the nut and the rotary support frame axial play to accommodate heat expansion of the spring during use of the unit. These features ensure centering and axial bracing of both the rotary and stationary support frames and the rotary and stationary refractory plates.

In accordance with a further feature of the present invention, there is provided a base plate removably connected to the outer jacket of the liquid melt container, and means, such as clamping shoes, for mounting removably the stationary support frame to the base plate. This feature, together with the separation of the support frames and the base plate, helps prevent wear of the container wall and excess heat stress being applied to critical elements of the unit.

In accordance with a further feature of the present invention, the rotary support frame has outer peripheral teeth for meshing engagement with suitable drive structure, thereby to achieve rotation in opposite directions of the rotary support frame and the rotary refractory member with respect to the stationary support frame and the stationary refractory member. By these features of the present invention, it is possible to install a turntable drive unit which is operable in opposite directions at any position around the periphery of the unit, with respect to the position of the pouring opening.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
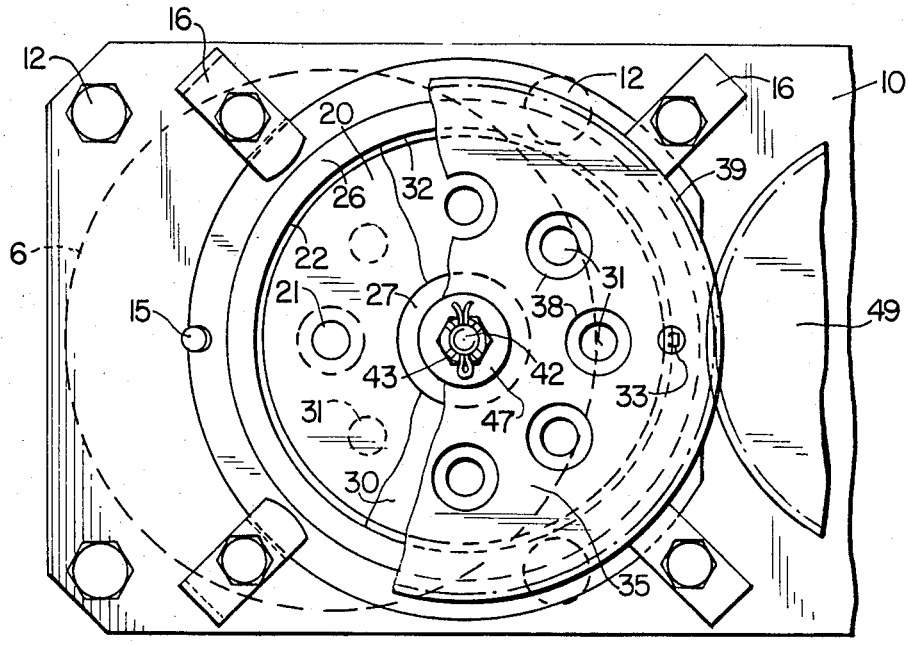
FIG. 1 is a bottom view of a rotary sliding closure unit in accordance with the present invention, certain of the elements being shown broken away to facilitate understanding of the structure of the unit.
Figure 2:
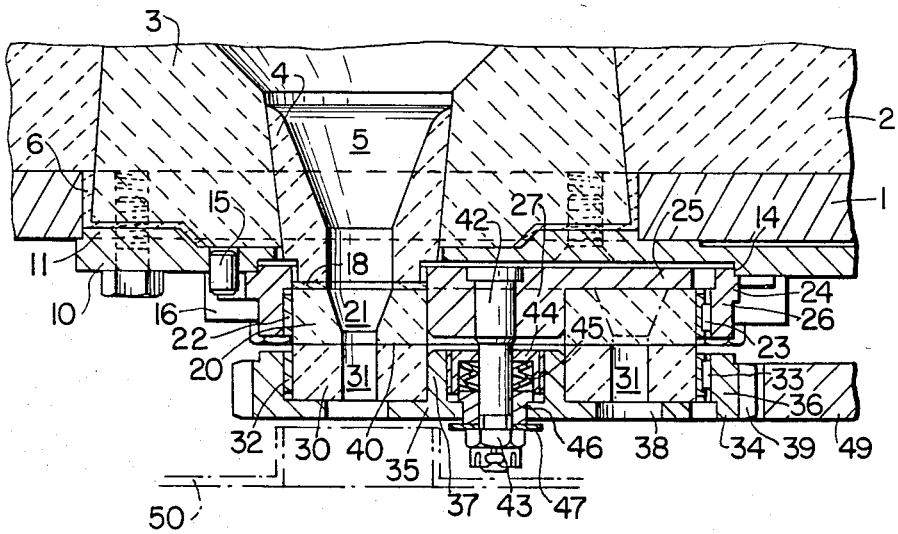
FIG. 2 is a vertical cross-sectional view through the unit of FIG. 1, additionally showing relative elements of a liquid melt container to which the unit is attached.

As shown in FIG. 2 of the drawings, a liquid melt container, for example a tundish in a continuous casting plant, includes an outer metal jacket 1 and an inner refractory lining 2. A refractory sleeve 3 is arranged in an opening in jacket 1 and lining 2. A discharge brick 4 is fitted within refractory sleeve 3 and has a wide funneled pouring opening 5.

The rotary sliding closure unit of the present invention includes a base plate 10 centered in an opening 6 in outer metal jacket 1 by a rim 11 and fastened to jacket 1 by means of screws or bolts 12. Base plate 10 forms a support for refractory sleeve 3 and the other elements, to be discussed below, of the unit. Furthermore, a turntable drive unit, or at least elements thereof, such as gear wheel 49, can be mounted on base plate 10.

The unit includes stationary elements and rotary elements. The stationary elements include a metal stationary support frame 24 adapted to be mounted removably on the base plate 10, and a stationary refractory plate 20 having therethrough a flow passage 21, stationary refractory plate 20 being supported by stationary support frame 24 such that flow passage 21 is in communication with pouring opening 5. The bottom of discharge brick 4 is sealed by means of refractory mortar joint 18 to a portion of the upper surface of stationary refractory brick 20.

The rotary elements include metal rotary support frame 34 and rotary refractory plate 30 positioned in sliding abutting contact with stationary refractory plate 20. Plate 30 has therethrough a plurality of flow passages 31 to be moved selectively into and out of alignment with flow passage 21. In the illustrated arrangement, there are eight circumferentially spaced flow passages 31, but any other suitable number may be employed.

The two refractory plates 20 and 30 each have an annular, ring-shaped configuration and have complementary, annular abutting relative sliding surfaces, generally indicated at 40. These sliding surfaces fit flush and are axially braced and centered in a manner to be described in more detail below. Preferably, plates 20 and 30 have the same external dimensions.

Both support frames 24,34 are disc-shaped and they include respective base portions 25,35 against which the respective ring-shaped plates 20,30 rest. Each of support frames 24,34 also have edge flanges 26,36 which surround the exterior peripheries of the respective ring-shaped plates. Each ring-shaped plate is mounted interchangeably in the respective support frame and is carried on its exterior periphery by the frame edge and is carried at the respective inner periphery defined by a respective center opening by a respective hub portion 27,37 of the respective support frame. Ring-shaped plates 20,30, which are constructed of a fire-proof refractory material, as will be understood by those skilled in the art, preferably are spanned on the exterior surfaces thereof by shrink fitted steel bands 22,32. The respective circumferential position for each ring-shaped plate 20,30 inside its respective support frame is fixed by a respective key 23,33 which locks into the respective steel band 22,32 and a key groove on the inner portion of the respective edge flange 26,36.

Support frame 24 is mounted detachably to base plate 10 with the aid of a plurality, for example four, of clamping shoes 16. Exact positioning between the support frame and the base plate is obtained through a groove 14 in the base plate and a pin 15 that is tightly fitted into the groove.

Support frame 34 has exterior peripheral teeth 39 for meshing engagement with a drive means, for example, a gear wheel 49 of a drive unit. This engagement may take place at any suitable location around the periphery of the unit, relative to the position of the pouring opening 5. Rotation is possible in both opposite directions. Frame 34 has in the base portion 35 thereof openings 38 for each of the flow passages 31.

Stationary refractory plate 20 optionally may contain other flow passages, in addition to flow passage 21, as illustrated by dashed lines in the right portion of FIG. 2, whereby it of course would be necessary to provide corresponding key grooves for key 23.

Rotary refractory plate 30 and rotary support frame 34 are connected to and urged toward stationary refractory plate 20 and stationary support frame 24 by structure including an axle or stud bolt 42 pressed into hub 27 of support frame 24. Bolt 42 thus forms an axis for the rotary components 30,34. A threaded sleeve 44 is screwed into hub 37 of support frame 34 and forms an axially adjustable spring rest against which bears a set of springs 45. A guide sleeve 46, which forms a radial guide for support frame 34 with respect to bolt 42, can be moved axially with respect to bolt 42 and frame 34, but axial movement outwardly is stopped on the inside of base portion 35 by an abutment flange, as shown in FIG. 2. In this abutted or stopped position, guide sleeve 46 undergoes a substantial, adjustable compression by springs 45. A nut 43 is tightened against an outer portion of sleeve 46 by means of a washer 47 and is secured on bolt 42 against rotation. Sleeve 46 projects slightly beyond the exterior of base portion 35, so that there is a definite axial play between the base portion 35 and washer 47. When the rotary sliding closure unit is in the mounted position shown in FIG. 2, nut 43 is tightened against sleeve 46 with a predetermined, limited turning moment, whereby the strong compression of springs 45 is not reduced. This turning moment thus determines the surface pressure between plates 20,30 on complementary sliding surfaces 40. Springs 45 are designed to absorb heat expansion during use of the unit, in particular, that of refractory plates 20,30 whereby the movement of the springs is limited to the above mentioned axial play between washer 47 and base portion 35.

To maintain the rotary sliding closure unit of the present invention, in particular to check and/or replace the refractory plates, nut 43 is removed from bolt 42, and the rotary members 34,30 can be removed, while the stationary members 20,24 will remain on the base plate 10. However, it is preferable to replace the entire rotary sliding closure unit, including both the stationary members and the rotary members, by detaching clamping shoes 16. The entire rotary sliding closure unit can be replaced easily and reliably exterior of the liquid melt container, and replacement with the aid of clamping shoes 16 can be done quickly, with only mortar seal 18 requiring replacement. Base plate 10, together with the rotary driving structure 49, etc., normally remains on the liquid melt container. A cover 50, shown by dashed lines in FIG. 2, may be provided to protect against heat radiation and metal spattering.

Opening and closing of the rotary sliding closure unit during operation is achieved by turning the rotary members. That is, the rotary members are rotated when it is desired to displace a given flow passage 31 with respect to the pouring opening and the flow passage 21. The arrangement of the present invention, particularly the exact guiding of the rotary members along the stationary members and the precise guiding of the refractory plates 20,30 along each other guarantees a high degree of safety against molten metal breakthrough and makes precise alignment of flow passages 31 with respect to flow passage 21 possible. For continuous casting operations, this is important in tundishes in order to control the amount of molten metal being discharged. If, after a continuous flowthrough of molten metal a particular flow passage 31 has been widened due to erosion, a new flow passage 31 may be placed in alignment with flow passage 21 by turning of the rotary members. Due to the large number of flow passages 31, it is possible to use the rotary sliding closure unit of the present invention for continuous operation without maintenance for a relatively long period of time.

During operation of the rotary sliding closure unit, it may occur that the pouring opening has to be opened from below with the aid of an oxygen lance, whereby damage to the flow passages cannot be avoided. For this purpose, however, an already "used" or "widened" flow passage 31 can be placed beneath the pouring opening by rotation of the rotary members. The further "use" or damage to such flow passage 31 by the oxygen lance does not matter, and after unblocking of the pouring opening, a new "unused" flow passage 31 may be rotated into alignment with flow passage 21.

Although the present invention has been described and illustrated with respect to a specifically preferred embodiment thereof, it is to be understood that various modifications and alterations will be apparent to one of ordinary skill in the art and may be made without departing from the scope of the present invention.

What is claimed is:

1. A rotary sliding closure unit for use with a liquid melt container of the type including an outer jacket, an inner refractory lining, and a pouring opening extending through the lining, said rotary sliding closure unit comprising:

a base plate adapted to be connected removably to the outer jacket of the liquid melt container;

a stationary support frame mounted removably on said base plate;

a stationary refractory plate having therethrough a flow passage, said stationary refractory plate being supported by said stationary support frame such that said flow passage is in communication with the pouring opening, said stationary refractory plate including a center opening and having an annular, ring-shaped configuration;

a rotary refractory plate positioned in sliding abutting contact with said stationary refractory plate and having therethrough a plurality of flow passages to be moved selectively into and out of alignment with said flow passage of said stationary refractory plate, said rotary refractory plate including a center opening and having an annular, ring-shaped configuration;

a rotary support frame supporting said rotary refractory plate against said stationary refractory plate for rotational movement with respect thereto;

said stationary and rotary refractory plates having complementary, annular, abutting relative sliding surfaces;

said stationary and rotary support frames comprising respective disc-shaped members having hubs extending into respective said center openings; and means, fixed to one of said support frames and without direct connection to said base plate, for coaxially aligning said stationary and rotary support frames and said stationary and rotary refractory plates, and for urging said rotary refractory plate toward said stationary refractory plate, said means comprising a bolt fixed in said hub of said stationary support frame and extending through said hub of said rotary support frame, a guide sleeve surrounding said bolt within a bore hole in said hub of said rotary support frame, and spring means acting between said guide sleeve and said rotary support frame for moving said rotary support frame away from said guide sleeve.

2. A unit as claimed in claim 1, further comprising a spring rest axially adjustably fixed to said hub of said rotary support frame, said spring means bearing on said spring rest.

3. A unit as claimed in claim 1, wherein said guide sleeve extends outwardly of said rotary support frame, and further comprising nut means threaded onto the outer end of said bolt and bearing against the outer end of said guide sleeve at a position spaced from said rotary support frame to define between said nut means and said rotary support frame axial play to accommodate heat expansion of said spring means during use.

4. A unit as claimed in claim 1, further comprising clamping shoes mounting said base plate to the outer jacket.

5. A unit as claimed in claim 1, wherein said rotary support frame has outer peripheral teeth means for meshing engagement with drive means, thereby to achieve rotation of said rotary support frame and said rotary refractory member with respect to said stationary support frame and said stationary refractory member.

6. In a liquid melt container including an outer jacket, an inner refractory lining, a pouring opening extending through said lining, and a rotary sliding closure unit for selectively blocking and unblocking said pouring opening, the improvement wherein said rotary sliding closure unit comprises:

a base plate removably connected to said outer jacket;

a stationary support frame mounted removably on said base plate;

a stationary refractory plate having therethrough a flow passage, said stationary refractory plate being supported by said stationary support frame such that said flow passage is in communication with the pouring opening, said stationary refractory plate including a center opening and having an annular, ring-shaped configuration;

a rotary refractory plate positioned in sliding abutting contact with said stationary refractory plate and having therethrough a plurality of flow passages to be moved selectively into and out of alignment with said flow passage of said stationary refractory plate, said rotary refractory plate including a center opening and having an annular, ring-shaped configuration;

a rotary support frame supporting said rotary refractory plate against said stationary refractory plate for rotational movement with respect thereto;

said stationary and rotary refractory plates having complementary, annular, abutting relative sliding surfaces;

said stationary and rotary support frames comprising respective disc-shaped members having hubs extending into respective said center openings; and means, fixed to one of said support frames and without direct connection to said base plate, for coaxially aligning said stationary and rotary support frames and said stationary and rotary refractory plates, and for urging said rotary refractory plate toward said stationary refractory plate, said means comprising a bolt fixed in said hub of said stationary support frame and extending through said hub of said rotary support frame, a guide sleeve surrounding said bolt within a bore hole in said hub of said rotary support frame, and spring means acting between said guide sleeve and said rotary support frame for moving said rotary support frame away from said guide sleeve.

7. The improvement claimed in claim 6, further comprising a spring rest axially adjustably fixed to said hub of said rotary support frame, said spring means bearing on said spring rest.

8. The improvement claimed in claim 6, wherein said guide sleeve extends outwardly of said rotary support frame, and further comprising nut means threaded onto the outer end of said bolt and bearing against the outer end of said guide sleeve at a position spaced from said rotary support frame to define between said nut means and said rotary support frame axial play to accommodate heat expansion of said spring means during use.

9. The improvement claimed in claim 6, further comprising clamping shoes mounting said base plate to said outer jacket.

10. The improvement claimed in claim 6, wherein said rotary support frame has outer peripheral teeth means for meshing engagement with drive means, thereby to achieve rotation of said rotary support frame and said rotary refractory member with respect to said stationary support frame and said stationary refractory member.

* * * * *